US005439267A

United States Patent [19]

Peterson et al.

[11] Patent Number: 5,439,267

[45] Date of Patent: Aug. 8, 1995

[54] CHAIR WITH ADJUSTABLE ARM ASSEMBLIES

[75] Inventors: Gordy Peterson, Grand Rapids; David D. Sayers, Kentwood; Charles P. Roossien, Wyoming; David L. Rundhaug, Grand Rapids; Kevin J. DeWeerd, Grand Rapids; Michael L. Deimen, Grand Rapids, all of Mich.

[73] Assignee: Steelcase Inc., Grand Rapids, Mich.

[21] Appl. No.: 69,172

[22] Filed: May 28, 1993

[51] Int. Cl.[6] ..... A47C 7/54

[52] U.S. Cl. ..... 297/411.36; 297/411.37; 297/411.2; 297/463.1

[58] Field of Search ..... 297/411.2, 411.26, 411.27, 297/411.35, 411.36, 411.37; 248/407, 408, 409; 292/228

[56] References Cited

U.S. PATENT DOCUMENTS

| | | |
|---|---|---|
| 42,650 | 5/1864 | Emery . |
| 251,069 | 12/1881 | Shaw . |
| 320,487 | 6/1885 | Matthie . |
| 346,784 | 8/1886 | Stanford . |
| 441,964 | 12/1890 | Neppert . |
| 449,689 | 4/1891 | Nauts . |
| 478,840 | 7/1892 | Biggs et al. . |
| 481,293 | 8/1892 | Bailey et al. . |
| 493,111 | 3/1893 | Parsons . |
| 493,441 | 3/1893 | Munz . |
| 533,619 | 2/1895 | Stuebing . |
| 550,685 | 12/1895 | Munz . |
| 560,547 | 5/1896 | Shotwell . |
| 659,089 | 10/1900 | McKinney . |
| 720,549 | 2/1903 | Adler . |
| 782,364 | 2/1905 | Soule . |
| 1,025,476 | 5/1912 | Mellen . |
| 1,070,278 | 8/1913 | McKinney . |
| 1,407,174 | 2/1922 | Simpson . |
| 2,310,346 | 2/1943 | Bell . |
| 2,549,902 | 4/1951 | Hibbard et al. . |
| 2,584,732 | 2/1952 | Okun . |
| 2,605,987 | 8/1952 | Brown et al. . |
| 2,650,650 | 9/1953 | Brown . |
| 3,063,752 | 11/1962 | Moore . |
| 3,124,328 | 3/1964 | Kortsch . |
| 3,206,249 | 9/1965 | Gateley . |
| 3,215,470 | 11/1965 | Swenson et al. . |
| 3,376,066 | 4/1968 | Kernes . |
| 3,474,993 | 10/1969 | Murcott . |
| 3,642,088 | 2/1972 | Smith . |

(List continued on next page.)

FOREIGN PATENT DOCUMENTS

| | | | |
|---|---|---|---|
| 2505158 | 11/1982 | France | 297/411.36 |
| 1481185 | 7/1977 | United Kingdom . | |

OTHER PUBLICATIONS

RH Form AB "Facts and Technical Details" literature. Publication date unknown.

The Chair Works "An Engineered Solution to Your Seating Needs" literature. Publication date unknown.

*Form & Function,* By Stephen MacDonald, "Elbow Support Chair", Publication date unknown.

*Primary Examiner*—Kenneth J. Dorner
*Assistant Examiner*—Milton Nelson, Jr.
*Attorney, Agent, or Firm*—Price, Heneveld, Cooper, DeWitt & Litton

[57] ABSTRACT

A chair includes a tubular arm support, an armrest, a lateral adjustment mechanism and a vertical height adjustment mechanism. The lateral adjustment mechanism includes a plurality of nested slides. One slide is connected to the vertical height adjustment mechanism. An uppermost slide supports the arm rest. The slides are adjustable laterally with respect to each other to position the armrest with respect to the chair. The vertical height adjustment mechanism includes a tubular liner insertable into the arm support. The liner defines a bore and a plurality of vertically spaced notches or grooves. A latch tube telescopes within the bore of the liner. An upper end of the latch tube is connected to the lateral adjustment mechanism. The latch is pivotally positioned within the latch tube. The latch includes a latch end movable into and out of engagement with the notches. An actuator engages the latch to move it between locked and unlocked positions.

37 Claims, 5 Drawing Sheets

U.S. PATENT DOCUMENTS 3,770,236 11/1973 Marsh et al. .
3,950,027 4/1976 Wilson ..... 297/411.35 X
3,992,058 11/1976 Mitjans .
3,993,351 11/1976 Rodaway .
4,003,168 1/1977 Brady .
4,085,763 4/1978 Thomas .
4,163,536 8/1979 Heller et al. .
4,277,102 7/1981 Aaras et al. .
4,456,298 6/1984 Gottstein .
4,489,980 12/1984 Friedrich .
4,489,981 12/1984 Goletski .
4,565,409 1/1986 Hollonbeck et al. .
4,660,885 4/1987 Suhr et al. .
4,693,442 9/1987 Sills .
4,786,108 11/1988 Dauphin .
4,815,688 3/1989 Wood .
4,822,103 4/1989 Stenvall .
4,844,390 7/1989 Duke .
4,951,995 8/1990 Teppo et al. .
4,961,610 10/1990 Reeder et al. .
4,968,094 11/1990 Froyland et al. .
4,971,393 11/1990 Maisenhalder .
5,009,467 4/1991 McCoy ..... 297/411.37 X
5,050,933 9/1991 Tornero et al. .
5,056,863 10/1991 DeKraker et al. .
5,058,840 10/1991 Moss et al. ..... 248/118.5
5,088,668 2/1992 Grimm ..... 248/118.3
5,104,073 4/1992 VanBeek et al. ..... 248/118.3
5,135,190 8/1992 Wilson ..... 248/118.1
5,143,422 9/1992 Althofer et al. .
5,215,282 6/1993 Bonutti .
5,265,938 11/1993 Melhuish et al. ..... 297/411.36
5,281,001 1/1994 Bergsten et al. ..... 297/411.35 X
5,318,347 6/1994 Tseng ..... 297/411.36

CHAIR WITH ADJUSTABLE ARM ASSEMBLIES

BACKGROUND OF THE INVENTION

The present invention relates to chairs and, more particularly, to an adjustable arm assembly for a chair.

A wide variety of task chairs are presently available for the office environment. In an attempt to adapt the chair to the particular user and to the task involved, various adjustment mechanisms have been provided. The chairs may, for example, include vertically adjustable seat height mechanisms, swivel/tilt mechanisms and adjustable back height mechanisms. In addition, office chairs may be provided with arm assemblies. Many such chairs have a fixed width between the armrests and a fixed vertical height. Such chairs have not, therefore, been readily adaptable to different users.

Various proposals have been made to provide vertical height adjustment for the armrests as well as lateral or width-wise adjustment of the armrests. An example of a laterally adjustable armrest for a chair may be found in commonly owned U.S. Pat. No. 5,056,863 entitled LATERALLY ADJUSTABLE ARMRESTS FOR A CHAIR, which issued on Oct. 15, 1991 to DeKraker et al. A vertical adjustment mechanism may be found in commonly owned U.S. Pat. No. 4,951,995 entitled ARM HEIGHT ADJUSTMENT MECHANISM FOR A CHAIR, which issued on Aug. 28, 1990 to Teppo et al.

A need exists for a chair and armrest assembly which is adapted for vertical height adjustment, which permits wide latitude in lateral positioning of the armrest, which is relatively easily manufactured, which is reliable in operation and which provides a wide variety of adjustable positions for the user.

SUMMARY OF THE INVENTION

In accordance with the present invention, the aforementioned needs are fulfilled. Essentially, an adjustable armrest mechanism is provided which may include a vertical height adjustment subassembly, a lateral adjustment subassembly or both.

The vertical height adjustment subassembly includes a liner which may be inserted into a chair arm support. The liner defines a bore having a plurality of vertically spaced notches or grooves. A latch tube is telescopingly positioned within the liner. A latch is carried by the latch tube. Provision is made for moving the latch between a locked position at which it engages one of the notches and an unlocked position which permits vertical movement of the tube with respect to the arm support.

The lateral adjustment mechanism includes a plurality of nested slides. One of the slides is attachable directly to the vertical height adjustment mechanism or to the arm support. An uppermost one of the slides mounts the armrest or arm cap. The slides are movable with respect to each other in lateral directions both inwardly and outwardly with respect to the centerline of the chair.

A wide variety of adjustable positions are provided. The assembly accommodates the chair to the particular user or to the task. The armrest assembly and adjustment mechanisms in accordance with the present invention are relatively easily manufactured, are adaptable to a wide variety of chairs and provide for reliable operation.

DETAILED DESCRIPTION OF THE PREFERRED EMBODIMENT

Figure 1:
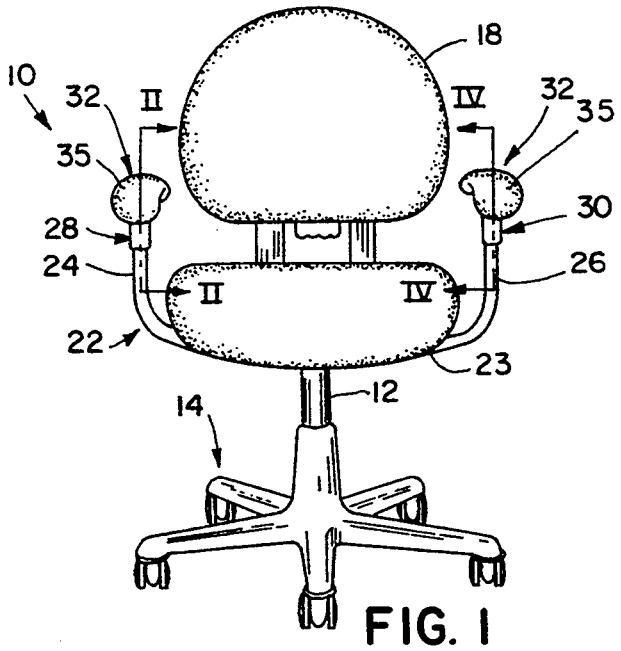
FIG. 1 is a front, elevational view of a chair incorporating armrest adjustment mechanisms in accordance with the present invention.
Figure 2:
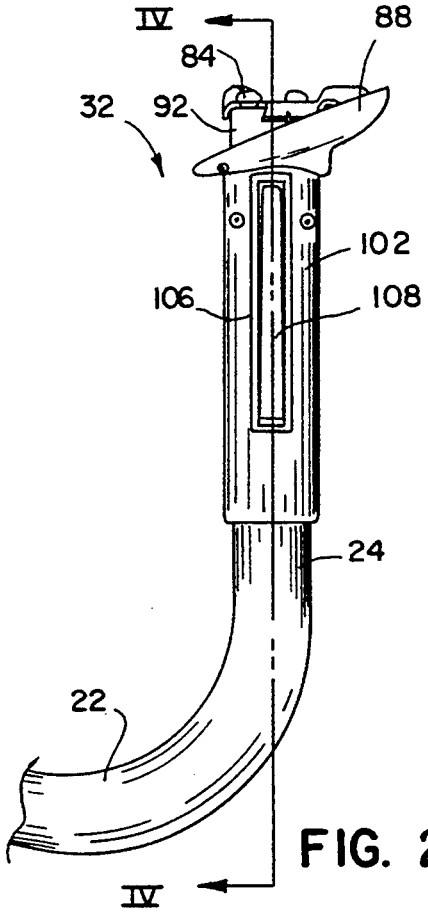
FIG. 2 is an enlarged, rear, elevational view of an armrest assembly incorporated in the chair of FIG. 1.
Figure 3:
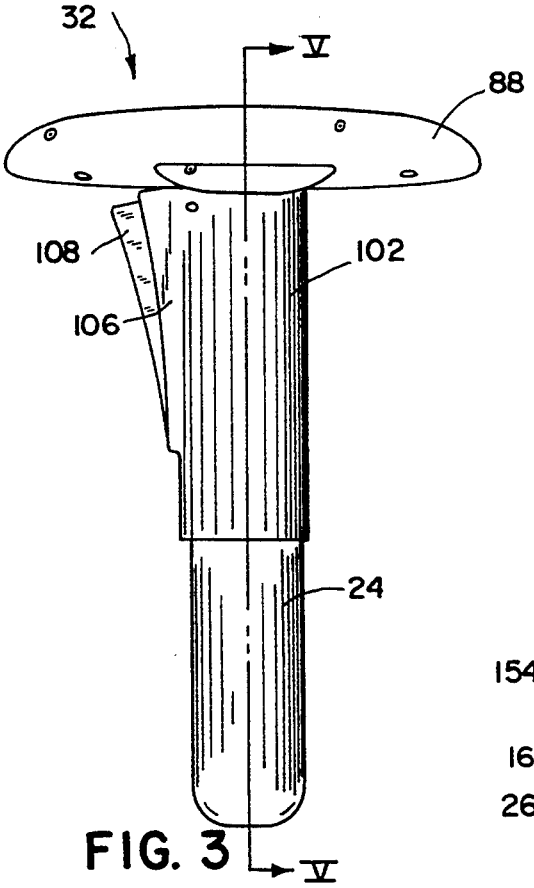
FIG. 3 is an end, elevational view of the armrest assembly.

A chair including an arm assembly in accordance with the present invention is illustrated in FIG. 1 and generally designated by the numeral 10. Chair 10 includes a support pedestal 12 mounted on a castered base 14. A chair seat 16 is supported on pedestal 12 by a suitable chair control (not shown). A chair back 18 is mounted on pedestal 12 by uprights 20. A generally U-shaped tubular armrest support 22 is mounted on chair 10. Support 22 includes a base 23 and vertical upright portions 24, 26 having ends 28, 30. Base 23 is secured to the understructure of the chair. Armrest assemblies 32 are positioned on upright portions 24, 26 of support 22. Each armrest assembly includes an armrest or cap 35.

Figure 4:
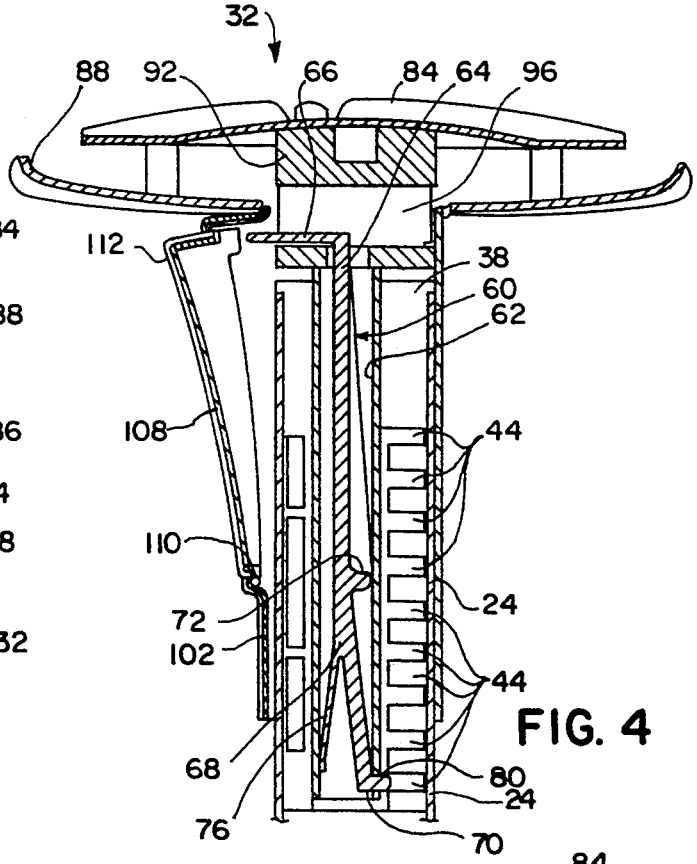
FIG. 4 is a cross-sectional view taken generally along line IV—IV of FIG. 2.
Figure 5:
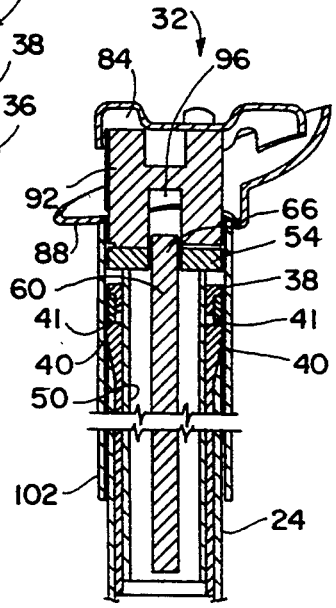
FIG. 5 is a cross-sectional view taken generally along line V—V of FIG. 3.

Armrest assemblies 32 provide for vertical height adjustment of the arm caps 35 with respect to the chair and tubular support 22. As best seen in FIGS. 2–6, each assembly 32 includes a generally tubular, elongated liner 36. Liner 36, as seen in FIGS. 4 and 5, is disposed within an open end of one of the uprights 24, 26. Liner 36 includes an upper, horizontal flange 38 which seats against a support upright. The liner further includes a pair of outwardly extending retention tabs 40. As seen in FIG. 5, tabs 40 extend into slots 41 formed in tubular upright 24. Liner 36 may be pushed into the open end of the upright until flange 38 engages the upright. The lock tabs will then extend into slots 41, as shown in FIG. 5. Withdrawal of liner 36 is, therefore, prevented. Liner 36 defines a noncircular or generally rectangular through bore 42. As seen in FIG. 4, liner 36 defines a plurality of vertically spaced grooves or notches 44 which open into bore 42.

A latch tube 50 is positioned in bore 42 for vertical movement. Latch tube 50 includes an elongated, noncircular tubular portion 52 and a horizontal flange 54. Flange 54, as described below, is connected to armrest 36 and will move therewith. In the presently preferred form, tubular portion 52 has a generally D-shape in cross section to correspond with the configuration of bore 42 of liner 36. The noncircular configuration of the tube and liner bore prevents relative rotation about a vertical axis of latch tube 50 with respect to liner 36 and, hence, arm support tube 22.

An elongated latch 60 is disposed within a central bore 62 defined by latch tube 50. As seen in FIG. 4, latch 60 includes an upper portion 64 terminating in a horizontal trigger end 66 and a lower portion 68 terminating in a latch end 70. Latch 60 further defines an integral pivot portion 72. Pivot portion 72 engages an inner surface of bore 62 of latch tube 50. An integral spring or spring finger 76 is formed with and extends from lower portion 68 opposite of latch end 70. Resilient spring finger 76 engages the internal surface of bore 62 opposite and below pivot portion 72. Spring 76, therefore, resiliently biases latch end 70 through a latch aperture 80 in portion 52 and towards engagement with one of the notches 44. When latch end 70 extends into one of the notches, vertical movement of latch tube 50 with respect to the liner and support tube is prevented. Pivoting of latch 60 about pivot portion 72 and in a clockwise direction, as viewed in FIG. 4, causes latch end 70 to disengage from one of the latch grooves or notches.

Figure 6:
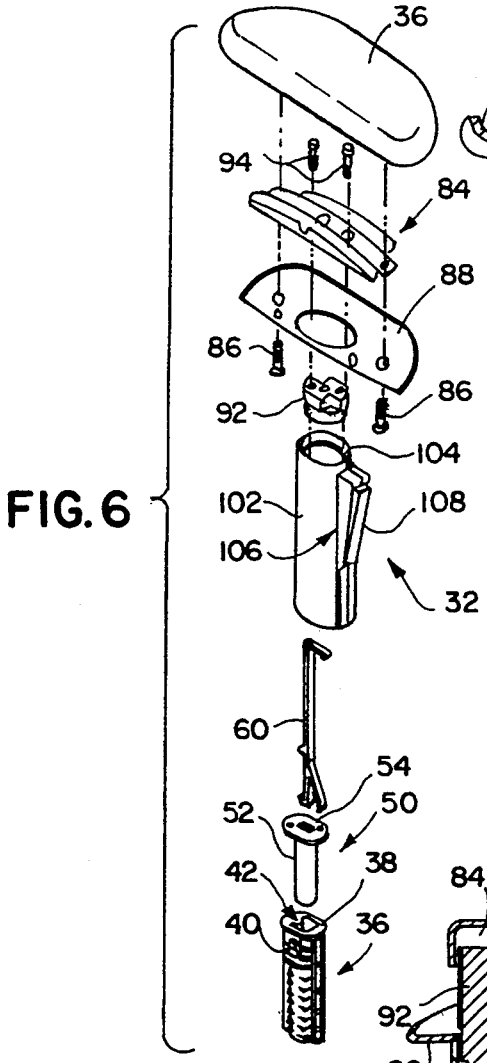
FIG. 6 is an exploded view of the armrest vertical height adjustment mechanism.

Arm cap 35 is secured to an attachment bracket 84, as best seen in FIG. 6. Fasteners 86 extend through a lower cap 88, bracket 84 and into arm cap 35. Bracket 84 is secured to a spacer block or cap attachment member 92 by fasteners 94. Fasteners 94, in turn, threadably engage flange 54 of latch tube 50. Trigger end 66 of latch 60 extends through a slot 96 formed in block 92.

An outer cover assembly or housing 102 is secured to attachment cap 92 and latch tube 50. Assembly 102 includes an upper peripheral flange 104 which is sandwiched between attachment member 92 and flange 54 of tube 50. Assembly 102 further defines a trigger housing 106. As seen in FIG. 4, a trigger 108 has a lower end 110 pivoted to the housing. An upper end 112 is movable into engagement with trigger end 66 of latch 60. When the user squeezes trigger 108, latch 60 is pivoted in a clockwise direction releasing latch end 70 from notch 44. Armrest 35, outer cover assembly 102 and latch tube 50 may, therefore, be moved vertically with respect to liner 36 and the support tube. When trigger 108 is released, spring finger 76 biases the latch in a counterclockwise direction, as viewed in FIG. 4, and latch end 70 will move into the next aligned notch 44. Independent vertical height adjustment of each armrest cap 36 is, therefore, provided.

Figure 7:
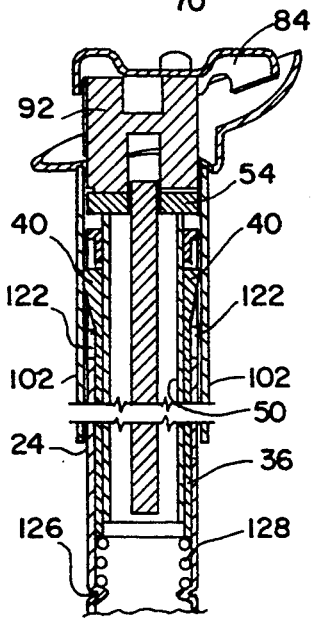
FIG. 7 is a cross-sectional view taken generally along line V—V of FIG. 3 showing an alternative form of the height adjustment mechanism.
Figure 8:
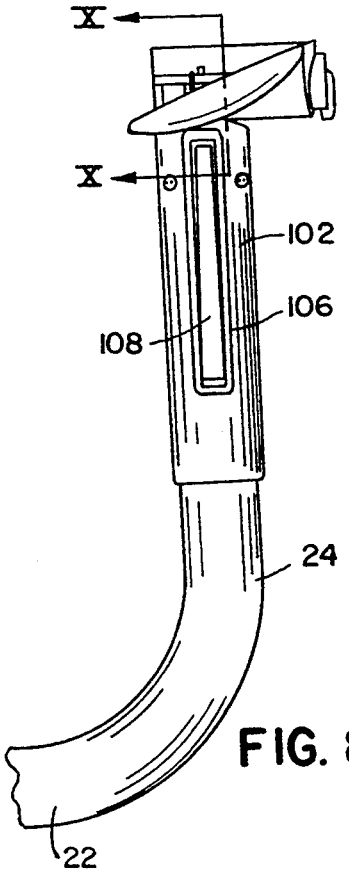
FIG. 8 is a rear, elevational view of an armrest adjustment mechanism incorporating lateral and vertical height adjustment.

A modified form of the vertical height adjustment mechanism is illustrated in FIG. 7. As shown therein, upright 24 includes opposed, elongated slots 122. Retention tabs 40 of liner 36 are movable within the slots and hence the liner 36 is movable vertically with respect to tubular upright 24. Upright 24 includes circumferential, inward crimp 126. Crimp 126 forms a lower stop or seat for a spring 128. The lower end of liner 36 rests on and engages spring 128. As a result, liner 36 may move vertically or float against the bias of coil spring 128 within tubular upright 24. This limited movement is cushioned by the spring and occurs when latch tube 50 is connected to liner 36 through latch 60.

Figure 10:
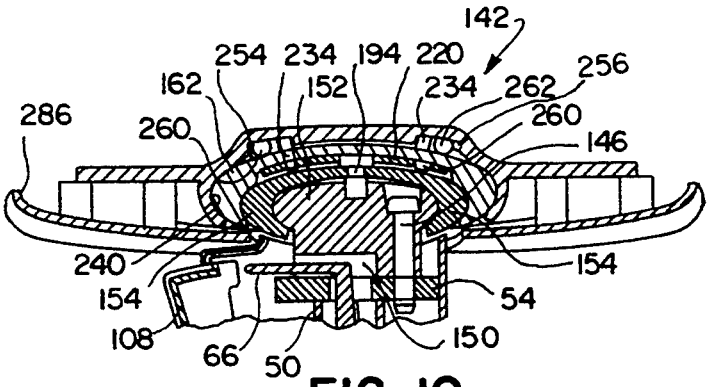
FIG. 10 is a cross-sectional view taken generally along line X—X of FIG. 8.

FIGS. 8–12 illustrate an embodiment of the present invention generally designated 140 and which incorporates a lateral adjustment mechanism 142. Lateral adjustment mechanism 142 includes a mounting cap mounting block or attachment block 144 secured to flange 54 of latch tube 50 by threaded fasteners 146. Mounting block 144 includes a lower portion 148 defining a slot 150 through which end 66 of latch 60 extends into engagement with trigger 108. Lower portion 148 is joined to an upper portion 152 which, as seen in FIG. 10, has a curved upper surface with outwardly extending, rounded flanges 154. Attachment block 144 forms the lowermost or first of a plurality of nested slides including a second slide 160, a third slide 162 and a fourth slide 164.

Figure 11:
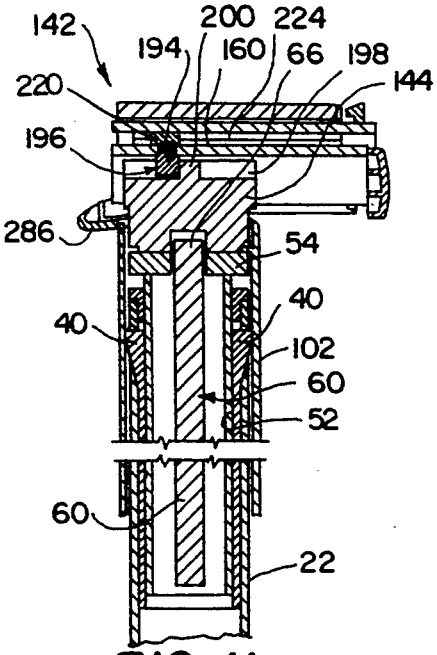
FIG. 11 is a cross-sectional view taken generally along line XI—XI of FIG. 9.
Figure 12:
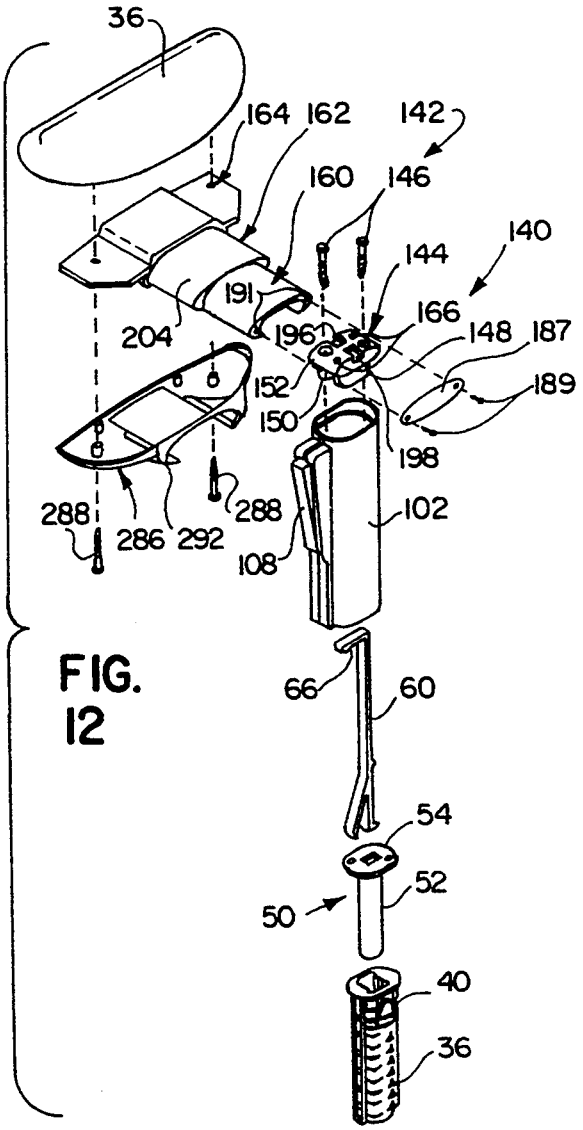
FIG. 12 is an exploded view of the embodiment of FIG. 8.
Figure 14:
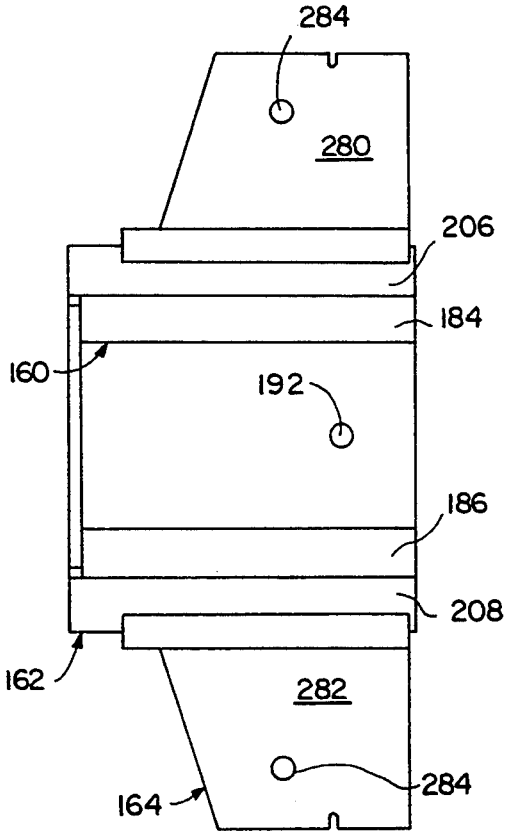
FIG. 14 is a bottom, plan view of the nested slide subassembly of FIG. 13.
Figure 13:
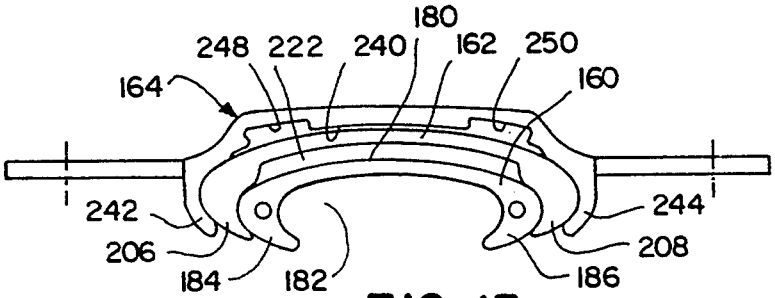
FIG. 13 is an end, elevational view showing the nested slide subassembly incorporated in the embodiment of FIG. 8.
Figure 15:
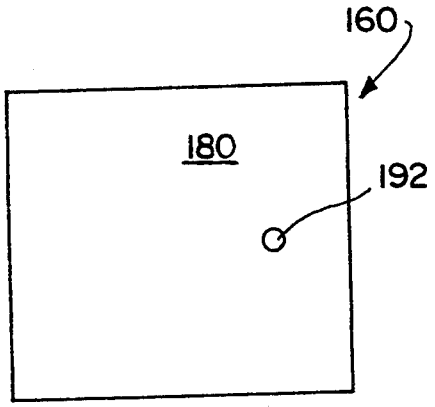
FIG. 15 is a top, plan view of the second slide incorporated in the assembly of FIG. 13.
Figure 16:
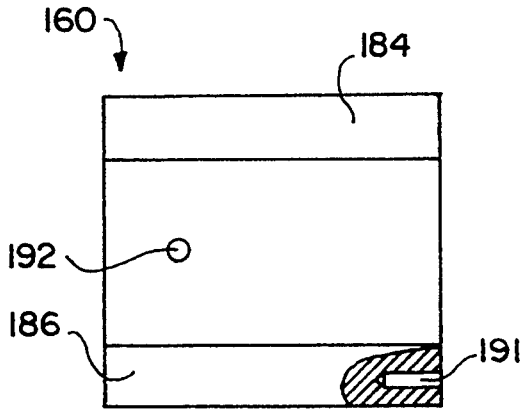
FIG. 16 is a bottom, plan view of the slide of FIG. 15.
Figure 17:
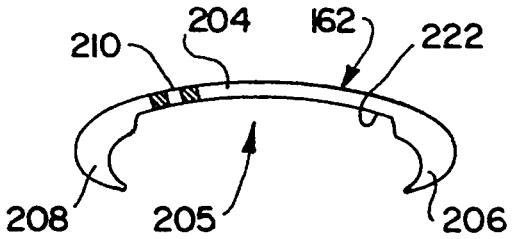
FIG. 17 is an end, elevational view of the third slide incorporated in the assembly of FIG. 13.

As seen in FIGS. 10, 12 and 13, slides 160, 162 and 164 are generally C-shaped in cross section. Slide 160 includes a curved upper surface 180, a downwardly opening channel 182 and inwardly turned flanges 184, 186. Channel 182, as seen in FIGS. 10 and 11, receives mounting block 144. Channel 182 of slide 160 is closed off outwardly by an end plate or cap 187. Cap 187 is secured to slide 160 by fasteners 189 which slideably engage bores 191. Slide 160 may move laterally about mounting block or first slide 144. Slide 160 is formed with an aperture 192. An elongated stop in the form of a headed rivet 194 extends through aperture 192. First slide 144 defines slots 196, 198 separated by a central wall 200. A lower end of stop 194 is disposed in slot 196. When assembly 142 is mounted on the opposite arm upright 24, the orientation of assembly 142 is reversed and stop 194 is received within slot 198.

Third slide 162 similarly includes a curved upper surface 204 and a central channel 205 defined by inturned lateral sides or flanges 206, 208. Third slide 162 defines a pair of spaced apertures 210, 212 which extend through upper surface 204 and open into channel 205 defined by the inturned sides 206, 208. Slide 162 is dimensioned to capture slide 160. Slide 162 may, therefore, move laterally with respect to slide 160 and, hence, with respect to slide or mounting block 144.

Figure 21:
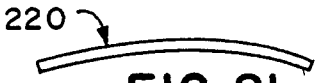
FIG. 21 is an end, elevational view of the stop plate of FIG. 20.
Figure 12A:
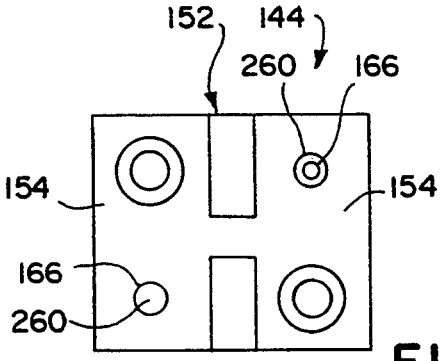
FIG. 12*a* is a top, plan view of a slide or mounting block incorporated in the embodiment of FIG. 8.
Figure 19:
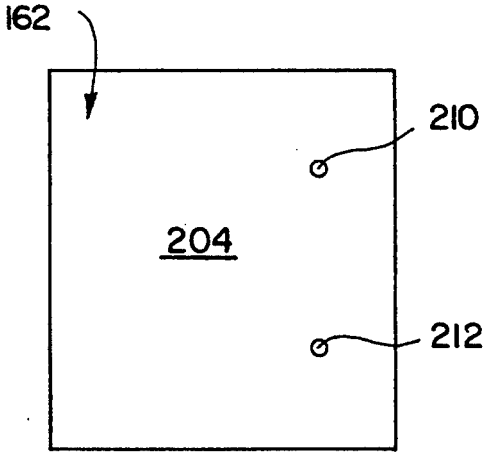
FIG. 19 is a top, plan view of the slide of FIG. 17.
Figure 18:
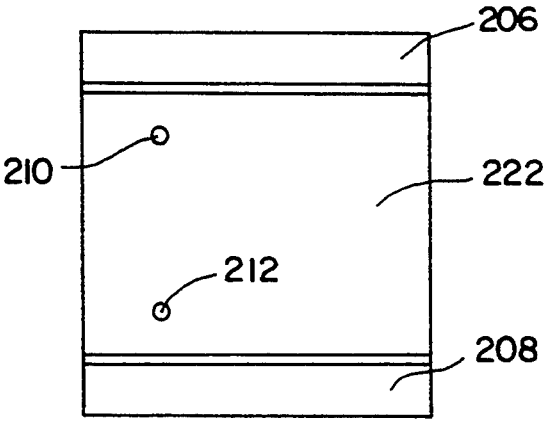
FIG. 18 is a bottom, plan view of the slide of FIG. 17.
Figure 20:
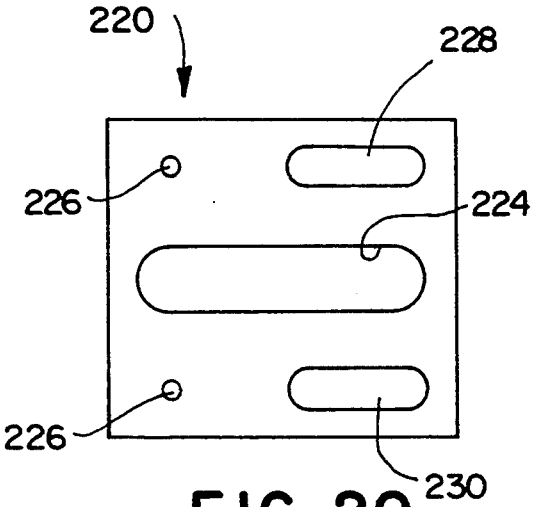
FIG. 20 is a plan view of a stop plate incorporated in the slide assembly.

A stop plate 220 is positioned between slides 160 and 162. Plate 220 is disposed within a groove 222 defined by slide 162. Stop plate 220, as shown in FIGS. 19 and 21, is curved to conform to the mating or opposed surfaces of slides 160, 162. Plate 220 includes an elongated central slot 224, attachment apertures 226 and bearing or race slots 228, 230. As seen in FIG. 10, stop plate 220 is secured to the undersurface of slide 162 by rivets, stops or suitable fasteners 234. Fasteners 234 extend through apertures 210, 212 formed in slide 162 and into attachment apertures 226 in stop plate 220. An upper end of stop 194 which is fixed to slide 160 is received within and guided by slot 224. Slide 162, therefore, may move with respect to slide 160 through the range of lateral motion provided by slot 224 of stop plate 220.

Outer slide 164 includes a central body portion which defines a lateral channel 240 in conjunction with inturned lateral sides or flanges 242, 244. The channel is dimensioned to capture and receive third slide 162. Slide 164 may move, therefore, laterally with respect to and telescope over slide 162.

Figure 9:
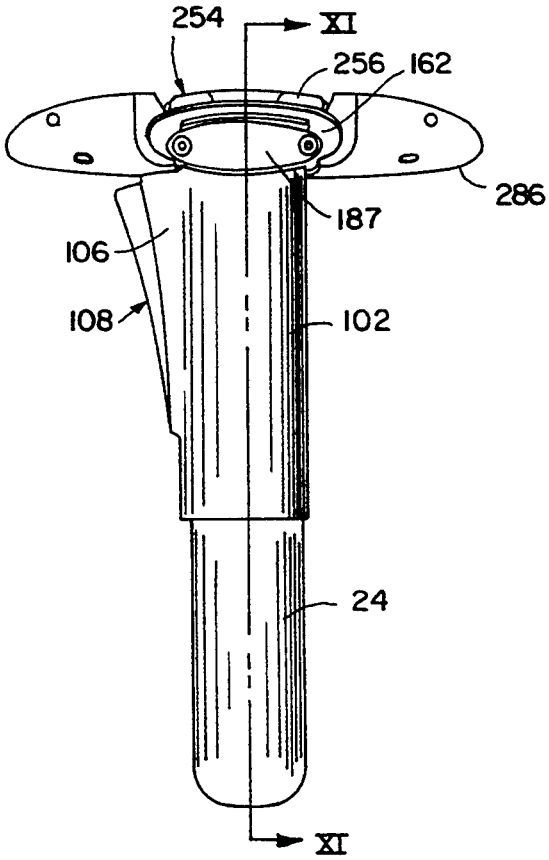
FIG 9 is an end, elevational view of the embodiment of FIG. 8.

Slide 164 further defines transverse grooves 248, 250 which open through one side of the slide. As seen in FIG. 10, stops 234 extending through slide 162 are received within grooves 248, 250. In addition, bearing races 254, 256 (FIGS. 9 and 10) are inserted into the outer open ends of grooves 248, 250. The races, as seen in FIG. 9, form outer stops to limit sliding motion of the outermost slide or fourth slide 164 with respect to the third slide 162. Elastomeric or rubber ball bearings 260, 262 are retained by races 254, 256. The bearings engage the outer surface of third slide 162 and the inner surface of fourth slide 164. Resilient bearings are used to provide a frictional interface between the slides to limit free motion so that when the slides are moved to a desired position, they will stay in place. Rubber bearings 260 are also placed within race slots 228, 230 of stop plate 220. Bearings 260, therefore, will engage an inner surface of slide 162 and an outer surface of slide 160. Slide 144 is formed with upwardly facing bores 166, which also receive bearings 260. The bearings, therefore, frictionally retain and insure the smooth motion of slide 160 with respect to slide 144. Also, it is presently preferred that the surfaces of slides 144, 160, 162 and 164 be coated with a Nylon 6/6 material. The coating may be sprayed onto preheated parts or applied in a pyrocoat process wherein an electric current is applied to the part which is then dipped in a liquid coating material. The coating is self lubricating, makes the parts wear resistant and results in even wear.

The plurality of nested slides in accordance with the present invention permit outward lateral movement of armrest 36 with respect to uprights 24, 26 as well as a range of inward lateral movement. Slides 160, 162, 164 may be moved as a unit on the first slide 144 or shifted independently of each other.

Slide 164 includes outwardly directed mounting tabs 280, 282. Tabs 280, 282 define apertures 284. A lower cap 286 is secured to the tabs by fasteners 288 extending through apertures formed in lower cap 286 and apertures 284. Lower cap 286 includes a configured channel or cover 292 which will receive slides 162, 160 and first slide 144.

Lateral mechanism 142 and the vertical height adjustment mechanism including latch 60 may be incorporated in the same arm assembly to provide a full range of vertical and lateral or width adjustment for the user. A chair incorporating such assemblies more readily adapts to the user, the user's environment and task. In the alternative, attachment block 144 of the lateral mechanism may be attached directly to support 22. Width adjustment only would be provided.

The mechanisms are relatively easily manufactured and assembled. The mechanisms are adaptable to substantially any chair. The lateral height adjustment mechanism is readily incorporated into available office chairs or combined with a vertical height adjustment mechanism.

In view of the above description, those of ordinary skill in the art may envision various modifications which would not depart from the inventive concepts disclosed herein. It is expressly intended, therefore, that the above description should be considered as only that of the preferred embodiment. The true spirit and scope of the present invention may be determined by reference to the appended claims.

The embodiments of the invention in which an exclusive property or privilege is claimed are defined as follows:

1. An adjustable armrest mechanism for a chair, said mechanism comprising:

an elongated liner adapted to be inserted into an arm support tube of a chair, said liner defining a bore open at a top and having a sidewall defining a plurality of vertically spaced notches;

a latch tube telescopingly positioned with said bore of said liner;

a latch mounted within said latch tube, said latch including an upper trigger end extending from said latch tube and a lower latch end positionable within one of said notches;

an armrest;

an armrest attachment member connected to said armrest and to said latch tube; and an actuator engaging said latch trigger end for moving said latch end out of engagement with said notches.

2. An adjustable armrest mechanism as defined by claim 1 further comprising:

a latch spring engaging said latch for resiliently biasing said latch end into engagement with one of said notches.

3. An adjustable armrest mechanism as defined by claim 1 wherein said latch comprises:

an elongated member defining a pivot portion engaging an inner surface of said latch tube; and a spring finger integral with said elongated member for biasing said latch end into engagement with one of said notches.

4. An adjustable armrest mechanism as defined by claim 3 further comprising:

an outer housing which telescopes around said liner, said outer housing being connected with said latch tube for vertical movement therewith.

5. An adjustable armrest mechanism as defined by claim 4 wherein said outer housing defines a trigger housing along one side thereof.

6. An adjustable armrest mechanism as defined by claim 5 wherein said actuator further comprises a trigger pivoted within said trigger housing and having an end which engages said latch trigger end.

7. An adjustable armrest mechanism as defined by claim 1 wherein said liner bore is noncircular and said latch tube has a cross section conforming thereto.

8. An adjustable armrest mechanism as defined by claim 7 further comprising:

a lower stop fixable with the arm support tube in spaced relationship with said liner; and a liner spring between said stop and a lower end of said liner for allowing said liner to float against the resilient bias of said spring.

9. An adjustable armrest mechanism as defined by claim 8 wherein said latch comprises:

an elongated member defining a pivot portion engaging an inner surface of said latch tube; and a spring finger integral with said elongated member for biasing said latch end into engagement with one of said notches.

10. An adjustable armrest mechanism as defined by claim 9 further comprising:

an outer housing which telescopes around said liner, said outer housing being connected with said latch tube for vertical movement therewith.

11. An adjustable armrest mechanism as defined by claim 10 wherein said outer housing defines a trigger housing along one side thereof.

12. An adjustable armrest mechanism as defined by claim 11 wherein said actuator further comprises a trigger pivoted within said trigger housing and having an end which engages said latch trigger end.

13. An adjustable armrest mechanism as defined by claim 1 further comprising:

armrest lateral adjustment means operatively connected to said attachment member for permitting lateral adjustment of the armrest.

14. An adjustable armrest mechanism as defined by claim 13 wherein said lateral adjustment means comprises:

a plurality of nested slide members, one of said slide members being slideably mounted on said attachment member for lateral movement with respect thereto.

15. An adjustable armrest mechanism as defined by claim 14 wherein said one of said slide members defines an elongated channel having an open end and a closed end, said attachment member being disposed within said channel.

16. An adjustable armrest mechanism as defined by claim 15 further including a stop fixed to said one of said slide members and engageable with said attachment member to limit lateral movement of said one of said slide.

17. An adjustable armrest mechanism as defined by claim 16 wherein said attachment member defines an upwardly facing bore and said lateral adjustment means further comprises an elastomeric bearing within said bore and engaging said one of said slide members.

18. An adjustable armrest mechanism as defined by claim 17 wherein each of said slide members has a generally C-shape in cross section.

19. An adjustable armrest mechanism as defined by claim 18 wherein the uppermost one of said slide members includes armrest attachment tabs.

20. An adjustable armrest mechanism as defined by claim 18 wherein said lateral adjustment means includes three nested slide members.

21. An adjustable armrest mechanism as defined by claim 20 wherein said lateral adjustment means further comprises:

a stop plate positioned between said one of said slide members and a second one of said slide members, said plate defining a first elongated slot within which said stop rides.

22. An adjustable armrest mechanism as defined by claim 21 wherein said lateral adjustment means further comprises another stop on the second of said slide members, said another stop being engagable with the third of said slide members and said stop plate.

23. An adjustable armrest mechanism as defined by claim 22 wherein said latch comprises:

an elongated member defining a pivot portion engaging an inner surface of said latch tube; and a spring finger integral with said elongated member for biasing said latch end into engagement with one of said notches.

24. An adjustable armrest mechanism as defined by claim 23 further comprising:

an outer housing which telescopes around said liner, said outer housing being connected with said latch tube for vertical movement therewith.

25. An adjustable armrest mechanism as defined by claim 24 wherein said outer housing defines a trigger housing along one side thereof.

26. An adjustable armrest mechanism as defined by claim 25 wherein said actuator comprises a trigger pivoted within said trigger housing and having an end which engages said latch trigger end.

27. An adjustable armrest mechanism for a chair, said mechanism comprising:

a tubular support adapted to be fixed to a chair;

an armrest; and lateral adjustment means fixed to said support for permitting lateral adjustment of said armrest with respect to said support, said adjustment means comprising:

a plurality of nested slides, one of said slides being fixed to said support and an outermost one of said slides being fixed to said armrest, said slides being laterally movable with respect to each other, and wherein said one of said slides fixed to said support defines a pair of lateral flanges.

28. An adjustable armrest mechanism as defined by claim 27 further comprising:

vertical height adjustment means between said tubular support and said one of said slides for permitting vertical height adjustment of said armrest.

29. An adjustable armrest mechanism as defined by claim 27 wherein a second of said slides has a generally C-shape in cross section thereby defining a channel which captures said one of said slides, said second of said slides moving laterally with respect to said first slide.

30. An adjustable armrest mechanism as defined by claim 29 wherein a third of said slides has a generally C-shape in cross section thereby defining a channel dimensioned to capture said second of said slides, said third of said slides moving laterally with respect to said second slide.

31. An adjustable armrest mechanism as defined by claim 30 further including a stop fixed to said second of said slides, said stop engaging said first of said slides and riding in a lateral groove defined by said first of said slides.

32. An adjustable armrest mechanism as defined by claim 31 further including:

a stop plate between said second and third of said slides, said plate defining a slot within which said stop rides.

33. An adjustable armrest mechanism as defined by claim 32 wherein a fourth of said slides is the outermost one of said slides.

34. An adjustable armrest mechanism as defined by claim 33 wherein said fourth of said slides is generally C-shaped in cross section thereby defining a channel which captures said third of said slides.

35. An adjustable armrest mechanism as defined by claim 34 further including:

another elongated stop extending through said third of said slides and being engagable with said fourth of said slides.

36. An adjustable armrest mechanism as defined by claim 35 wherein said stop plate defines a race slot and said adjustment means further includes an elastomeric bearing riding in said race slot.

37. An adjustable armrest mechanism as defined by claim 36 further including additional elastomeric bearings between said first and second of said slides and said third and fourth of said slides.

* * * * *